US010214950B2

(12) United States Patent
Frank

(10) Patent No.: US 10,214,950 B2
(45) Date of Patent: Feb. 26, 2019

(54) HINGE

(71) Applicant: MANFRED FRANK PATENT HOLDINGS LIMITED, Papakura (NZ)

(72) Inventor: Manfred Johannes Frank, Papakura (NZ)

(73) Assignee: MANFRED FRANK PATENT HOLDINGS LIMITED, Papakura (NZ)

( * ) Notice: Subject to any disclaimer, the term of this patent is extended or adjusted under 35 U.S.C. 154(b) by 0 days.

(21) Appl. No.: 15/500,304

(22) PCT Filed: Jun. 30, 2015

(86) PCT No.: PCT/IB2015/054887
§ 371 (c)(1),
(2) Date: Jan. 30, 2017

(87) PCT Pub. No.: WO2016/016746
PCT Pub. Date: Feb. 4, 2016

(65) Prior Publication Data

US 2017/0218671 A1 Aug. 3, 2017

(30) Foreign Application Priority Data

Jul. 30, 2014 (NZ) ..... 628113

(51) Int. Cl.
*E05F 1/08* (2006.01)
*E05D 3/06* (2006.01)
(Continued)

(52) U.S. Cl.
CPC ..... *E05D 7/04* (2013.01); *E05D 3/06* (2013.01); *E05D 3/16* (2013.01); *E05D 7/0423* (2013.01);
(Continued)

(58) Field of Classification Search
CPC ..... E05D 7/04; E05D 7/06; E05D 7/0415; E05D 3/186; E05D 3/06; E05D 3/122;
(Continued)

(56) References Cited

U.S. PATENT DOCUMENTS 2,078,815 A * 4/1937 Sugar ..... E05D 3/022 126/194
2,206,739 A * 7/1940 Brogren ..... E05D 3/06 16/354
(Continued)

FOREIGN PATENT DOCUMENTS

GB 869191 5/1961

*Primary Examiner* — Chuck Y Mah
(74) *Attorney, Agent, or Firm* — Dann, Dorfman, Herrell and Skillman, P.C

(57) ABSTRACT

A poly axial hinge comprising a mounting plate, a first arm pivotally coupled to a panel mounting element, a second arm pivotally coupled in an scissoring manner with the first arm by a main pivot, and a third arm pivotally coupled to the second arm at a location part way between a first end of said second arm and the main pivot. The mounting plate includes at least one rigidly fixed first gear, and the third arm includes gear teeth directly or indirectly coupled together with the fixed gear, such that rotation of the second arm with respect to said mounting plate causes rotation of the first arm with respect to the second arm, thereby driving the poly axle hinge open and/or closed.

11 Claims, 14 Drawing Sheets

(51) Int. Cl.

| | |
|---|---|
| ***E05D 7/00*** | (2006.01) |
| ***E05D 7/04*** | (2006.01) |
| ***E05D 7/06*** | (2006.01) |
| ***E05D 3/16*** | (2006.01) |

(52) U.S. Cl.
CPC ..... *E05D 7/06* (2013.01); *E05D 2007/0461* (2013.01); *E05Y 2201/694* (2013.01); *E05Y 2201/71* (2013.01); *E05Y 2900/20* (2013.01)

(58) Field of Classification Search
CPC ..... E05D 3/16; E05D 2003/163; E05D 11/06; E05Y 2201/618; E05Y 2201/62; E05Y 2201/71; E05Y 2201/716; E05Y 2201/712; Y10T 16/541; Y10T 16/5475; Y10T 16/5474; Y10T 16/547; Y10T 16/53864
See application file for complete search history.

(56) References Cited

U.S. PATENT DOCUMENTS

| | | | | |
|---|---|---|---|---|
| 2,535,960 | A | 12/1950 | Schmidt | |
| 3,363,281 | A | 1/1968 | Borsani | |
| 3,714,678 | A | 2/1973 | Weisz et al. | |
| 4,251,900 | A | 2/1981 | Lautenschlager | |
| 4,470,170 | A | 9/1984 | Gerteis | |
| 4,584,738 | A | 4/1986 | Lautenschlager | |
| 4,827,569 | A | 5/1989 | Mertes | |
| 4,837,894 | A | 6/1989 | Lin | |
| 5,035,026 | A | 7/1991 | Carlo et al. | |
| 5,056,951 | A | 10/1991 | Mariani | |
| 5,058,238 | A | 10/1991 | Lautenschlager | |
| 5,074,609 | A | 12/1991 | Dear | |
| 5,102,084 | A * | 4/1992 | Park | G06F 1/1616 16/338 |
| 5,437,079 | A | 8/1995 | Park | |
| 5,450,655 | A * | 9/1995 | Ferrari | E05D 3/16 16/368 |
| 5,500,983 | A | 3/1996 | Lautenschlager | |
| 6,049,946 | A | 4/2000 | Cress et al. | |
| 6,141,832 | A | 11/2000 | Salice | |
| 6,308,376 | B1 * | 10/2001 | Koshikawa | E05D 3/16 16/250 |
| 6,402,270 | B1 | 6/2002 | Frank | |
| 6,487,755 | B1 | 12/2002 | Caldari | |
| 6,684,453 | B2 | 2/2004 | Wang | |
| 7,197,790 | B1 | 4/2007 | Edmondson | |
| 7,350,273 | B1 * | 4/2008 | Skipper | E05D 3/16 16/366 |
| 7,574,775 | B2 * | 8/2009 | Zetti | E05D 3/16 16/266 |
| 7,694,389 | B2 | 4/2010 | Erickson et al. | |
| 7,698,785 | B2 | 4/2010 | Bennett | |
| 7,814,617 | B2 | 10/2010 | Frank | |
| 2001/0025398 | A1 | 10/2001 | Zetti | |
| 2006/0237989 | A1 * | 10/2006 | Kuan | B62D 25/12 296/76 |
| 2008/0216288 | A1 * | 9/2008 | Hoffman | E05D 3/127 16/354 |
| 2011/0000136 | A1 * | 1/2011 | Brun | E05D 3/06 49/358 |
| 2011/0097138 | A1 * | 4/2011 | Eikelenboom | B64G 1/222 403/81 |
| 2012/0175478 | A1 * | 7/2012 | Chen | G06F 1/1624 248/286.1 |
| 2013/0227819 | A1 | 9/2013 | Frank et al. | |
| 2014/0174227 | A1 * | 6/2014 | Hsu | E05D 3/14 74/98 |

* cited by examiner

HINGE

FIELD OF THE INVENTION

The present invention relates to concealed hinges. More particularly the present invention relates to poly-axial hinges suitable for high and/or very high load applications. More particularly still, the present invention relates to an improved poly-axial hinge suitable for high and/or very high load applications and having an improved range of motion.

BACKGROUND OF THE INVENTION

International patent specifications WO2006/062415 and WO2012/020362 describe adjustable, poly-axial hinges. Both patent specifications describe a poly-axial hinge in which height adjustment of the mounting element is facilitated by adjusting the height of the distal region of an arm (to which the mounting element is connected) relative to the proximal region of the arm. This adjustment is especially important for high loading applications, because it allows the hinge to be mounted first, then any fine adjustment necessary can be made.

Poly-axial hinges may also be used to support building façades. Wind loading and pressure changes on façade panels can cause stress on the panel if it is mounted rigidly. Therefore, there is need for articulation of the mounting element to compensate for slight movement of the panel due to such wind loading, and pressure changes. An effective means for facilitating articulation of the mounting element is important while also being low maintenance and suitable for high cycle and high loading applications.

In many types of architectural design (residential and/or commercial) it is often desirable to hinge large and/or very heavy panels in order to achieve a desired aesthetic goal.

The poly-axial hinges described above are particularly adapted to high load and very high load applications where large span or heavy panels are mounted. One example is for glass panels which are typically heavy and it is often desirable to hinge large panels of glass. The hinges described above (in WO2006/062415 and WO2012/020362) for this type of application are complex, typically made from stainless steel to withstand the elements, and manufactured to very tight machining tolerances in order to achieve smooth operation, long life, and to eliminate unwanted movement or 'play'. However, these hinges are capable of swinging a panel or door through approximately only 90-100 degrees at best.

It would be also be desirable to provide a high precision and/or high strength hinge assembly adapted for high and/or very high load applications, that also had an improved range of motion, while still remaining relatively compact. It would additionally be particularly desirable to provide such an improved range of motion hinge, adapted for also mounting large thickness panels in the range of 5-90 mm thick or more.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

It is an object of the present invention to provide an improved hinge mounting assembly or hinge assembly which overcomes or at least partially ameliorates some of the abovementioned disadvantages or which at least provides the public with a useful choice.

SUMMARY OF THE INVENTION

In a first aspect the present invention consists in a poly axial hinge comprising:

- a mounting plate,
- a first arm pivotally coupled to a panel mounting element at its first end,
- a second arm pivotally coupled in an scissoring manner with the first arm by a main pivot, and pivotally coupled to said mounting plate at its first end,
- a third arm pivotally coupled at a first end to said second arm at a location part way between said first end of said second arm and a said main pivot,
- a first link member pivotally coupled at one end to said second end of said second arm, and pivotally coupled at another end to said panel mounting element,
- a second link member pivotally coupled at one end to said second end of said first arm, and pivotally coupled at another end to another end of said third arm,
- wherein said mounting plate includes at least one rigidly fixed first gear, and said third arm includes gear teeth directly or indirectly coupled together with said fixed gear, such that rotation of said second arm with respect to said mounting plate causes rotation of said first arm with respect to said second arm thereby driving the poly axle hinge open and/or closed.

According to a further aspect said first link member and said second link member are adjustable in length.

According to a further aspect said hinge includes one or more further gears located between said first gear and said third arm, all engaged to transfer motion between said first gear and said gear teeth of said third arm.

According to a further aspect said at least one fixed gear is arranged inboard of said second arm.

According to a further aspect said at least one fixed gear is arranged outboard of said second arm.

According to a further aspect said second arm is bent when viewed from a direction parallel to said pivotal couplings.

According to a further aspect there are a total of eight pivoting couplings.

According to a further aspect each pivoting coupling is substantially parallel, (i.e. <5° deviation).

According to a further aspect said hinge includes a biasing member to bias said hinge in one of a fully open condition and/or a fully closed position.

According to a further aspect said hinge includes a spring, or spring and damper means, to retard a final portion of motion of said hinge as it approaches one of a fully open condition and/or a fully closed position.

According to a further aspect said biasing member acts between said mounting plate and said second arm.

According to a further aspect said biasing member acts between said geared arm and said second arm.

According to a further aspect said spring, or spring and damper means acts between said mounting plate and said second arm.

According to a further aspect said spring, or spring and damper means acts between said geared arm and said second arm.

According to a further aspect said biasing member acts between said mounting plate and said panel mounting element.

According to a further aspect said spring, or spring and damper means acts between said geared arm and said panel mounting element.

According to a further aspect said hinge includes a positive stop member to prevent motion of said hinge beyond a fully open condition, and/or a fully closed position.

According to a further aspect said biasing member acts between said mounting plate and said second arm.

According to a further aspect said positive stop member acts between said geared arm and said second arm.

According to a further aspect said positive stop member acts between said mounting plate and said panel mounting element.

According to a further aspect said spring, or spring and damper means acts between said geared arm and said panel mounting element.

According to a further aspect the first arm is formed in two parts comprising:

a height control arm pivotally coupled to a main arm portion.

According to a further aspect the height control arm is located at the first end of the first arm and is coupled to the panel mounting element.

In another aspect the present invention consists in a poly axial hinge comprising a poly-axial hinge comprising:

at least one pivoting coupling between a first link and a second link incorporating complementary convex and concave members respectively engaged with one another and movable with respect to one another to facilitate slight articulation between the first link and the second link, and wherein a pair of concave members are each located between a mounting element such that a first side bears against the mounting element and a second concave side engages with a respective convex surface in a cupping manner, and wherein at least one of the pair of concave members is adjustable for location and/or attitude with respect to the mounting element.

According to a further aspect said pivoting coupling pivots on a composite (multipart) pin assembly comprising an internally threaded sleeve and an externally threaded main pin, wherein the length of the pin assembly can be adjusted via co-operation of said threaded sleeve and said externally threaded main pin, to compress said concave members against said complementary convex member.

According to a further aspect at least one arm of said hinge is formed in two parts comprising a height control arm which is pivotally coupled to a main arm portion.

According to a further aspect the height control arm is located substantially within a bifurcated portion of the main arm portion.

According to a further aspect the hinge is as claimed in any one of claims 1 to 21.

According to a further aspect a pin is located through aligned passageways of the convex member and concave members, the pin also being engaged with the mounting element to couple the mounting element to the height control arm, and wherein the pin is dimensioned such that there is a clearance with respect to the passageway of the convex member to allow at least limited articulating movement of the mounting element relative to the height control arm.

According to a further aspect the concave members comprise an outer cup lined with an inner cup having a concave bearing surface.

According to a further aspect the outer cup is metallic and the inner cup is of a polymer bearing material.

According to a further aspect the concave members can move relative to the convex surfaces due to the clearance between the pin and the passageway of the convex surfaces.

In another aspect the present invention consists in a poly axial hinge comprising a poly-axial hinge comprising a multi-axis hinging mechanism having 8 at least substantially parallel axes operable to articulate a panel mounting element relative to a mounting plate through more than 100°, wherein said mechanism includes a geared portion rigidly fixed with respect to said mounting plate, and cooperating (directly or indirectly) with and arm of said hinge.

In another aspect the present invention consists in a poly axial hinge comprising:

a mounting plate, a first arm pivotally coupled to a panel mounting element at its first end, a second arm pivotally coupled in an scissoring manner with the first arm by a main pivot, a third arm pivotally coupled to said second arm at a location part way between a first end and a second end of said third arm, and pivotally coupled to a mounting plate at its first end, a first link member pivotally coupled at one end to said second end of said second arm, and pivotally coupled at another end to said panel mounting element, a second link member pivotally coupled at one end to said second end of said first arm, and pivotally coupled at another end to another end of said third arm, wherein said mounting plate includes a rigidly fixed first gear teeth, and said second arm includes second rigidly fixed gear teeth, said first gear teeth and said second gear teeth cooperating such that rotation of said panel mounting element with respect to said mounting plate and causes rotation of said third arm.

According to a further aspect said first link member and said second link member are adjustable in length.

According to a further aspect said hinge includes one or more further gears located between said first gear and said third arm, all engaged to transfer motion between said first gear and said gear teeth of said third arm.

According to a further aspect said second arm is bent when viewed from a direction parallel to said pivotal couplings.

According to a further aspect there are a total of eight pivoting couplings.

According to a further aspect each pivoting coupling is substantially parallel, (i.e. <5° deviation).

According to a further aspect said hinge includes a biasing member to bias said hinge in one of a fully open condition and/or a fully closed position.

According to a further aspect said hinge includes a spring, or spring and damper means, to retard a final portion of motion of said hinge as it approaches one of a fully open condition and/or a fully closed position.

According to a further aspect said biasing member acts between said mounting plate and said second arm.

According to a further aspect said biasing member acts between said third arm and said second arm.

According to a further aspect said spring, or spring and damper means acts between said mounting plate and said second arm.

According to a further aspect said spring, or spring and damper means acts between said third arm and said second arm.

According to a further aspect said biasing member acts between said mounting plate and said panel mounting element.

According to a further aspect said spring, or spring and damper means acts between said third arm and said panel mounting element.

According to a further aspect said hinge includes a positive stop member to prevent motion of said hinge beyond a fully open condition, and/or a fully closed position.

According to a further aspect said biasing member acts between said mounting plate and said second arm.

According to a further aspect said positive stop member acts between said third arm and said second arm.

According to a further aspect said positive stop member acts between said mounting plate and said panel mounting element.

According to a further aspect said spring, or spring and damper means acts between said third arm and said panel mounting element.

According to a further aspect the first arm is formed in two parts comprising:

a height control arm pivotally coupled to a main arm portion.

According to a further aspect the height control arm is located at the first end of the first arm and is coupled to the panel mounting element.

In another aspect the present invention consists in hinges as herein described and with reference to any one or more of the accompanying drawings.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

For the purposes of this specification the term poly-axial hinge shall be construed to mean any hinge having multiple hinge members that articulate relative to one another about more than one pivot axis. The hinges defined in international patent specifications WO2006/062415 and WO2012/020362 are examples of 7 pivot poly-axial hinges.

Importantly, the present invention is applicable to concealed hinges, (i.e. hinges that cannot be seen from the outside when closed). It is especially difficult to design concealed hinges with excellent load bearing capability, while still remaining relatively compact.

For the purposes of this specification the term "high load" application is intended to mean that a single pair of hinges can support and articulate a panel up to approximately 250-350 kg, or more before failure.

Further, the term "very high load" application is intended to mean that a single pair of hinges can support and articulate a panel up to approximately 3000 kg, or more before failure.

For example:

A pair of hinges when manufactured from a polymer material (e.g. fibre reinforced plastic), may be rated to safely support a hinged panel weighing up to approximately 100 kg (with a safety factor of approximately three (i.e. failure occurs around 300+ kg), making these hinges suitable for high load applications).

Similarly, steel hinges may be rated to safely support a hinged panel weighing up to approximately 120 kg (with a safety factor of approximately three (i.e. failure occurs around 360 kg), making these hinges suitable for high load applications).

A pair of heavy duty steel hinges, may be rated to safely support a panel of up to approximately 500 kg (with a safety factor of approximately 6 (i.e. failure occurs around 3000 kg), making these heavy duty steel hinges suitable for very high load applications).

For the purposes of this specification the term frusto spherical shall be construed to mean an object or part of an object that is generally shaped as a truncated sphere, however it also includes shapes beyond those that are strictly "frusto spherical" and can include apertures and/or other features while still being generally "frusto spherical".

For the purposes of this specification the terms link, linkage or similar shall be construed to mean any linking member irrespective of the forces transferred by the member.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention will now be described by way of example only and with reference to the drawings in which.

DETAILED DESCRIPTION OF THE INVENTION

Figure 10A:
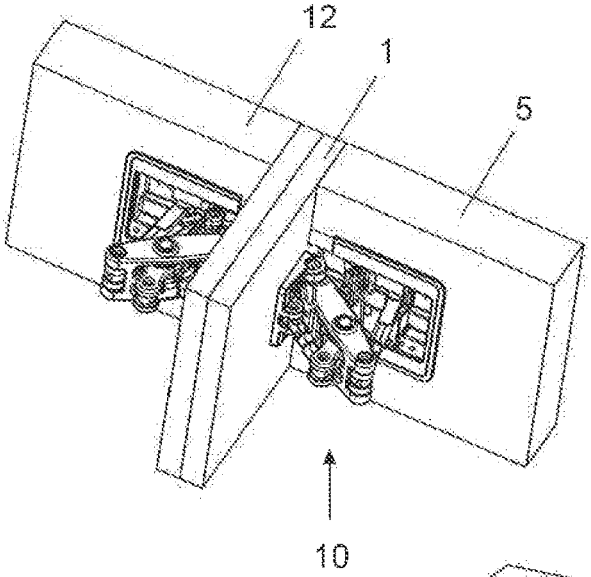
FIG. 10 is a perspective view of another hinge showing different possible hinging configurations applicable to the present hinge.
Figure 10B:
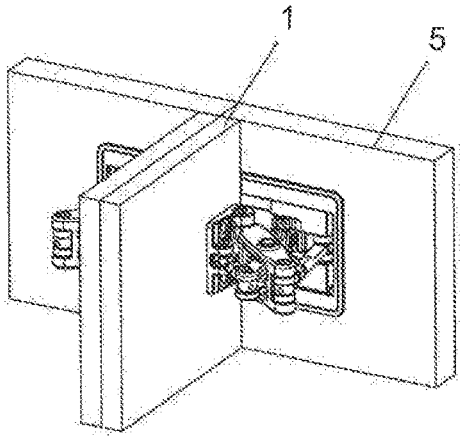
Figure 10C:
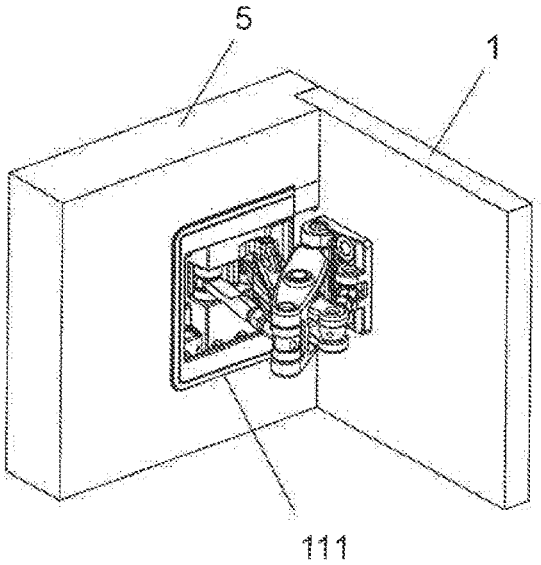

With reference to FIGS. 10*a-c*, arrangements of an existing hinge assembly are shown in 'inset', 'overlay', and 'end mount' configurations.

It will be appreciated that the hinges described in this specification are also suitable for 'inset', 'overlay', 'end mount' and for 'back to back'/'curtain wall' installation configurations. Further, it will be appreciated that the 'end mount' configuration illustrated in FIG. 10*c*, is particularly suitable for models where a mortised hinged plate 111 is used to hinge panel 5, so that the mortised cutout is obscured from view when installed.

One of the important advantages of the present hinge mounting assemblies is that they can also be used on all of these mounting styles and can mount thick panels, and very thick panels (i.e. 30 mm-55 mm (i.e. thick), and/or 55 mm-90 mm or more (i.e. very thick)). It will be appreciated that the present hinge assembly is suitable to be used in the hinging configurations illustrated in FIGS. 10*a-c*.

There is no high or very high load hinging system that can mount panels in this thickness range in any one of the three above hinging styles. Further, there is no high or very high load hinging system that can provide an opening angle in the range of up to 160-180 degrees and beyond. While, many previous systems claim to be suitable for "thick" panels, they are suitable for panels only up to approximately 30 mm.

Existing hinges, simply cannot swing the panels out enough to provide the necessary clearance when hinging such "thick" panels (30 mm-55 mm), or "very thick" panels (i.e. 55 mm-90 mm, or more), as these terms are defined in the present specification.

Further, when the panels are in these "thick" or "very thick" ranges, they become very heavy. Existing hinges are not adequate to hinge large panels (either in height, span, or thickness, or combinations of all three).

In most cases, the only solution with existing hinges is to provide a large number of hinges to spread the load (although even then, known systems cannot work with very thick panels, or thick panels beyond approximately 90° of range of motion).

The solution of using multiple hinges has several very significant disadvantages. Firstly, the cost of multiple hinges (i.e. at least three and often eight or more hinges) increases accordingly. Secondly, it becomes increasingly difficult to install the hinged panel or door, when multiple hinges are used. Precise location and adjustment of more than two hinges to provide smooth hinging motion, becomes extremely difficult and sometimes virtually impossible. Thirdly, the use of multiple hinges can have a significant negative effect on aesthetics.

To effectively hinge very thick and large panels without needing a large number of individual hinges (i.e. preferably only a pair), requires complex high load hinges like those described in WO2006/062415 and WO2012/020362, the contents of which are hereby incorporated by reference in their entirety. However, for many applications, these hinges are not capable of swinging the panel through a large enough range.

It is envisaged that more than a pair of the present hinges may be utilised in order to hinge panels beyond the weight bearing capability of a single pair.

The present invention provides a poly-axial hinging assembly that is particularly suited for cabinetry, door mounting applications, building facades, and a wide range of applications where the combination of:

- high or very high load applications, and
- clearance for thick or very thick panels (30-55 mm or 55 mm-90 mm), and
- range of motion of hinged panel of 160-180 degrees, or more.

As a result, the major structural components are preferably made of a metallic material to provide the best load bearing capability. In particular, stainless steel is most preferred as it is less susceptible to corrosion.

However, it is also anticipated that the hinges (and in particular the arms and links) could be made from a polymer material. However, when polymer arms and/or links are employed, the hinge assembly is unlikely to be suitable for very high load applications. Nevertheless, such a hinge provides a new solution, being a high load hinge, with the capability to swing a thick panel through a (previously unattainable) wide range of motion in the order of up to 160 to 180 degrees and beyond.

In FIGS. 1-5, a poly-axial hinge 10 is shown. The hinge 10 is suitable for mounting to a fixed frame 1 or other structural element via the frame mounting plate 2. Mounting the hinge 10 to a fixed frame or other structural element via the mounting plate 2 can be achieved by the use of screws, bolts or other fasteners as would be apparent to a person skilled in the art. A plurality of apertures 202 are preferably provided in frame mount 2 for this purpose.

Once mounted, the hinge 10 is preferably adjustable in all planes in order to locate the panel 5 (or door 5 or other object 5) in the desired position. The hinge is a poly-axial hinge, and more specifically, it includes eight axes or pivots (16, 26, 17, 18, 13, 3, 7, 22).

With particular reference to FIGS. 1-5, the hinge 10 includes a first arm 14 and a second arm 15 pivotally coupled together via a pin 13. The first arm 14 is pivotally coupled to the panel mounting hinge plate 111 via link arm 19 of the panel hinge plate 111. Likewise the second arm 15 is pivotally coupled via pin 22 to the mounting plate 2.

Link arm 32 is pivotally coupled to the first arm 14 at its proximal end via pin 16. First arm 14 is preferably a composite arm comprising additional adjustable link arm 32 to control the height of the mounting hinge plate 111. Link arm 32 can be articulated about pin 30, so that the distal end of arm 14,32 can change the height of panel mount 111. Alternatively, first arm 14 may not be a composite arm, but rather a rigid member.

Adjustable links 24 and 21 are provided to couple the arms 15 and 14 to mounting hinge plate 111 and mounting plate 2 respectively.

The hinge of the present invention can be fully adjusted post installation. Importantly, the adjustment can be easily made while the hinge is fully loaded by a hinged panel 5. Height adjustment is facilitated via adjustment of the link arm 32. The link arm 32 is pivotally coupled to the first arm 14 via a pivot pin 30. The link arm 32 is able to pivot about the pivot pin to enable height adjustment movement. Movement of the link arm 32 results in movement of the panel mounting hinge plate 111 in a vertical direction (when typically installed) and therefore vertical movement of any panel or door or other moveable object mounted to the mounting hinge plate 111.

Adjustment of the position of the link arm 32 is preferably facilitated by height adjusting screws 4 which have tips that may abut the outer surfaces of the link arm 32. The orientation of the longitudinal axis of the screws 4 is preferably substantially perpendicular to the surface of the link arm 32.

In alternative embodiments, the surface of the link arm 32 may be profiled to be complementary to the shape of the tip of the adjustment screws 4 to avoid point loading and wear.

Figure 8:
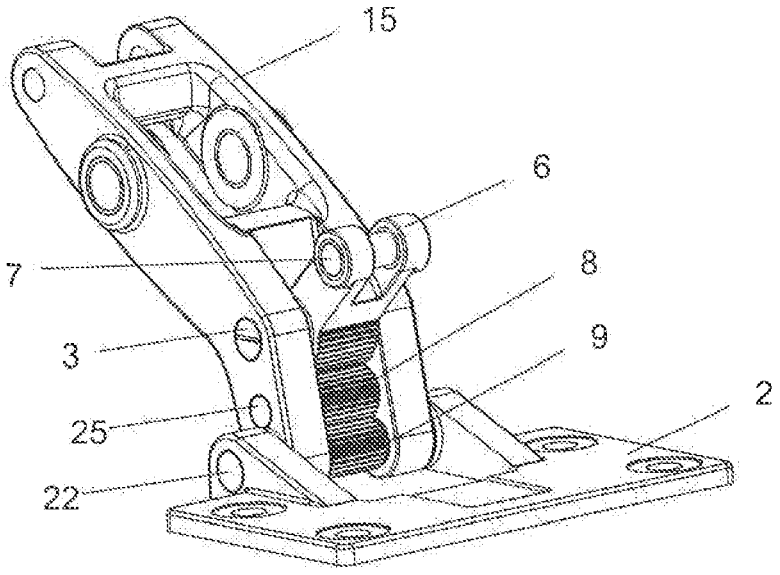
FIG. 8 is a perspective view of the main cranking arm 15, shown attached to the frame mount 2.
Figure 9:
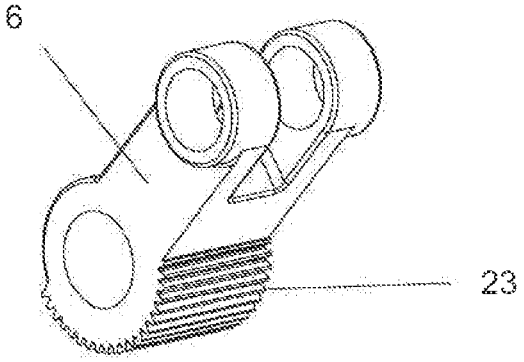
FIG. 9 is a perspective view of geared arm 6.

With particular reference to FIGS. 8 and 9, further features of the hinge of FIGS. 1 to 5 will be described in more detail.

The second arm 15 of hinge 10 is coupled to the mounting plate 2, via pin 22. Pin 22 is rigidly mounted with respect to mounting plate 2. For example, pin 22 may be keyed, splined or include indents that cooperate with one or more grub screws associated with mounting plate 2, so that pin 22 cannot rotate with respect to mounting plate 2. It will be appreciated by those skilled in the art that any other suitable technique for preventing rotation of the pin 22 with respect to the mounting plate 2, may be employed.

Gear 9 is provided on pin 22, and is rigidly mounted with respect to mounting plate 2. In some forms, the teeth of gear 9 maybe machined into mounting plate 2.

Second arm 15 is pivotally mounted on pin 22, so that arm 15 can rotate with respect to mounting plate 2.

Geared link arm 6 is attached to second arm 15 via pivot pin 3 and includes an annular array (with respect to pivoting pin 3) of gear teeth 23 on an outer surface. As a result, geared link arm 6 is able to rotate about the axis of pin 3 with respect to second arm 15.

The other end of geared link arm 6 is attached by pivoting pin 7 to adjustable link 21.

Rotational movement of arm 15 about pin 22 is transferred to the geared portion of geared arm 6 via the interaction of gear 9 and idler gear 8. Idler gear 8, is mounted to rotate freely with respect to second arm 15 via pin 25.

As a result of the above described arrangement, rotational movement of arm 15 with respect to mounting plate 2, causes movement of geared link arm 6, which in turn, drives the opening and closing of the remaining linkages of hinge 10.

It will be appreciated that where the various links and arms are described as pivotally coupled "at an end", this should be given a broad meaning. In particular, it will be appreciated that it is not necessary that the members are joined precisely at the end, rather simply may be towards and/or near an end.

Figure 14:
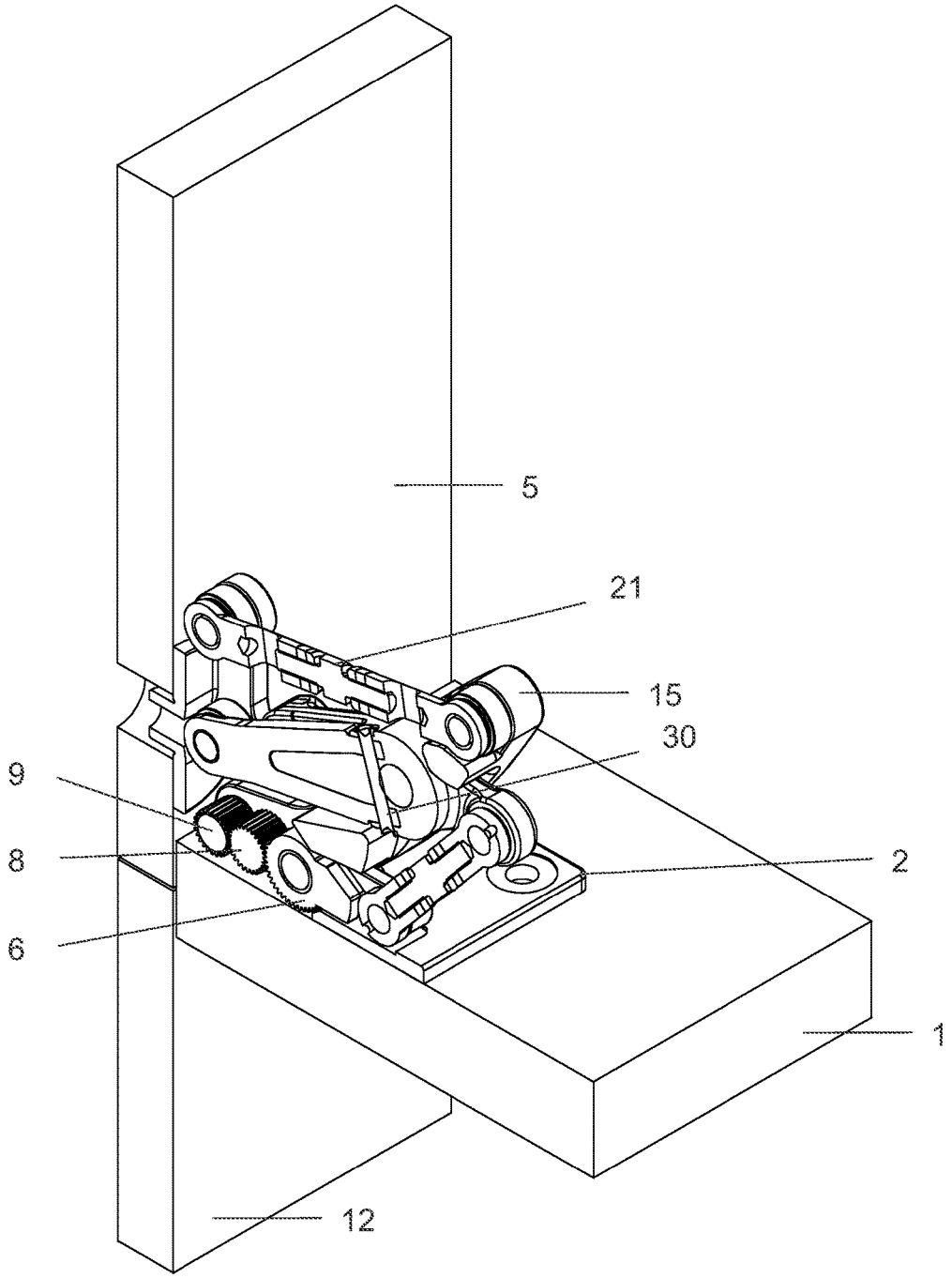
FIG. 14 is a cross-section view of the hinge of FIG. 1.
Figure 15:
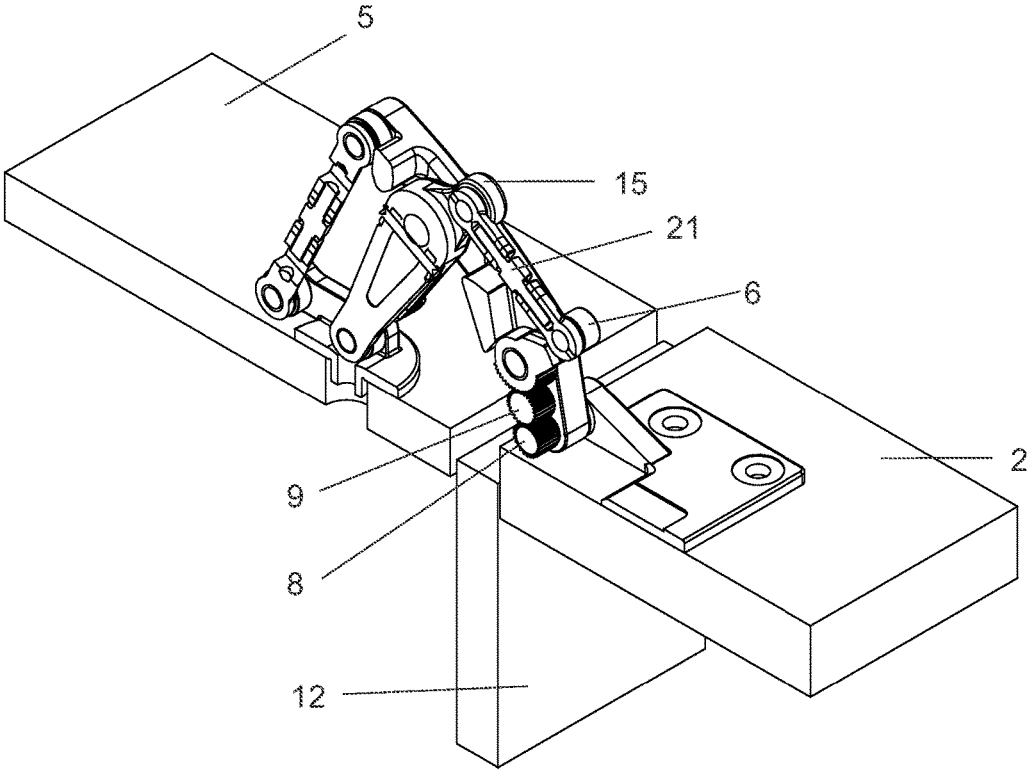
FIG. 15 is a cross-section view of the hinge of FIG. 2.
Figure 16:
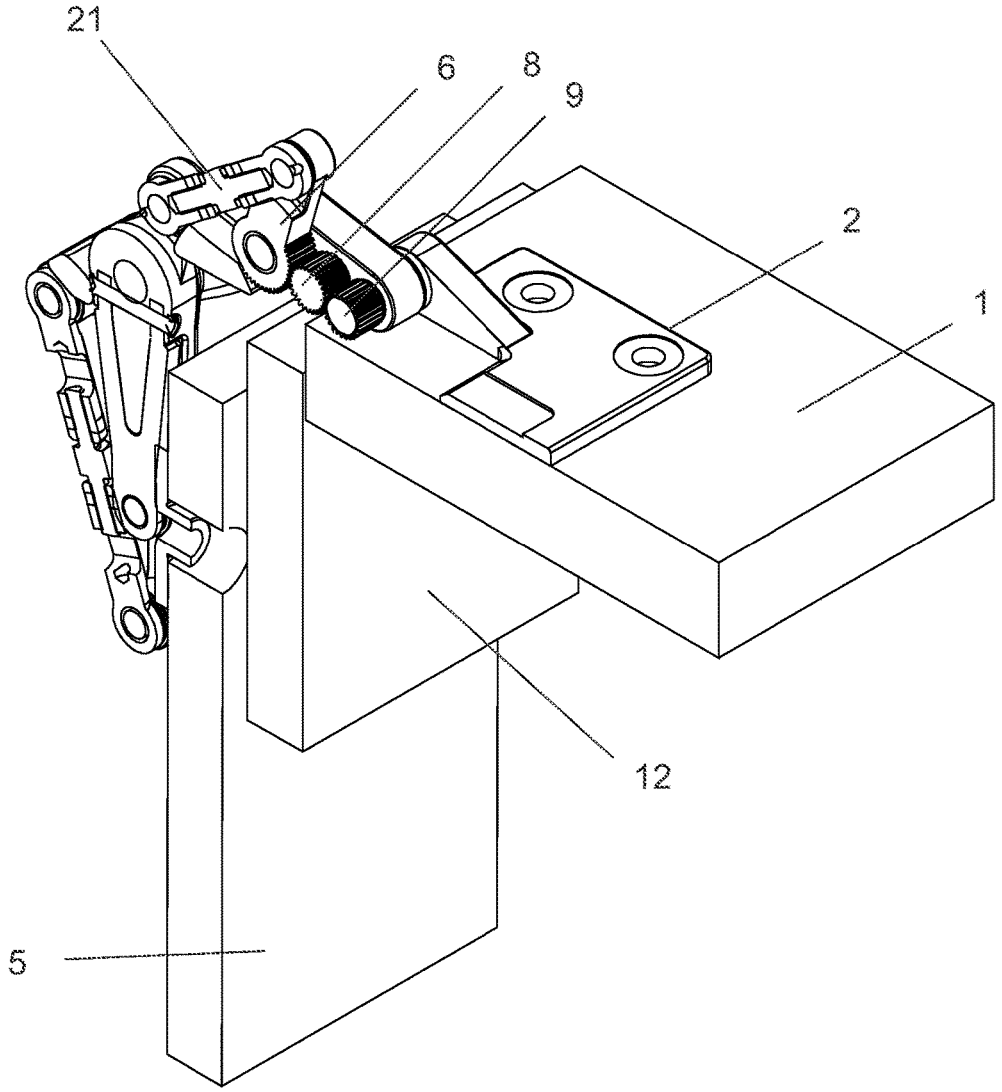
FIG. 16 is a cross-section view of the hinge of FIG. 3.

With particular reference to FIGS. 14 to 16, a preferred hinge is shown in closed (0°), partially open (90°), and fully open (180°) positions. It will be appreciated that the above described mechanism results in controlled motion of each interacting hinge link (and set of gears) throughout the entire range of motion of the hinge 10.

The 'knee shaped' second arm 15 preferably includes a bend in order to provide adequate clearance for hinged panel 5 around panel 12 (see particularly FIG. 15). That is, the pivot pins 17, 13 and 22 do not lie in a straight line. The additional clearance provided when second arm 15 is bent, is particularly useful when the hinge is intended for use with very thick panels.

As best illustrated in FIG. 16, it can be seen that hinged panel 5 could extend beyond 180°, but for the fact that it will impact panel 12. It will be appreciated that applications where a range of motion beyond 180° is desirable, can also be accommodated by the present hinge design.

Geared link 6, idler gear 8, and gear 9, act together as a gearbox transferring motion of arm 15 into rotation of geared arm 6, that drives the opening of the remaining hinge links. It is anticipated that the relative sizing of the gears can be modified to achieve different drive ratios, to achieve different characteristics of the hinge 10.

Figure 1:
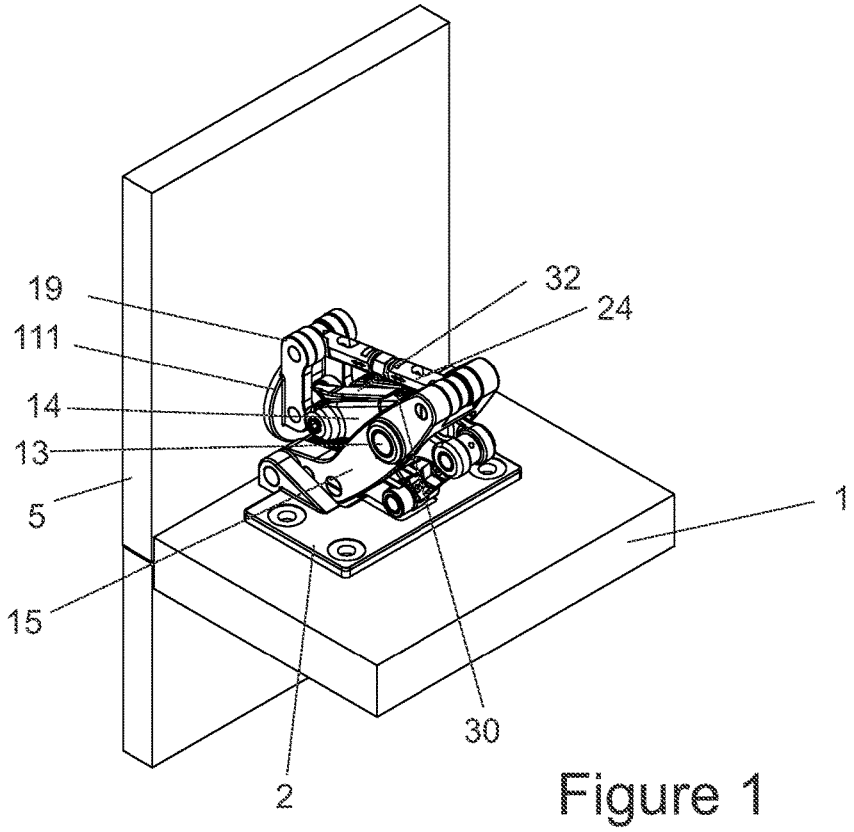
FIG. 1 is a perspective view of a preferred hinge shown in a fully closed position.
Figure 2:
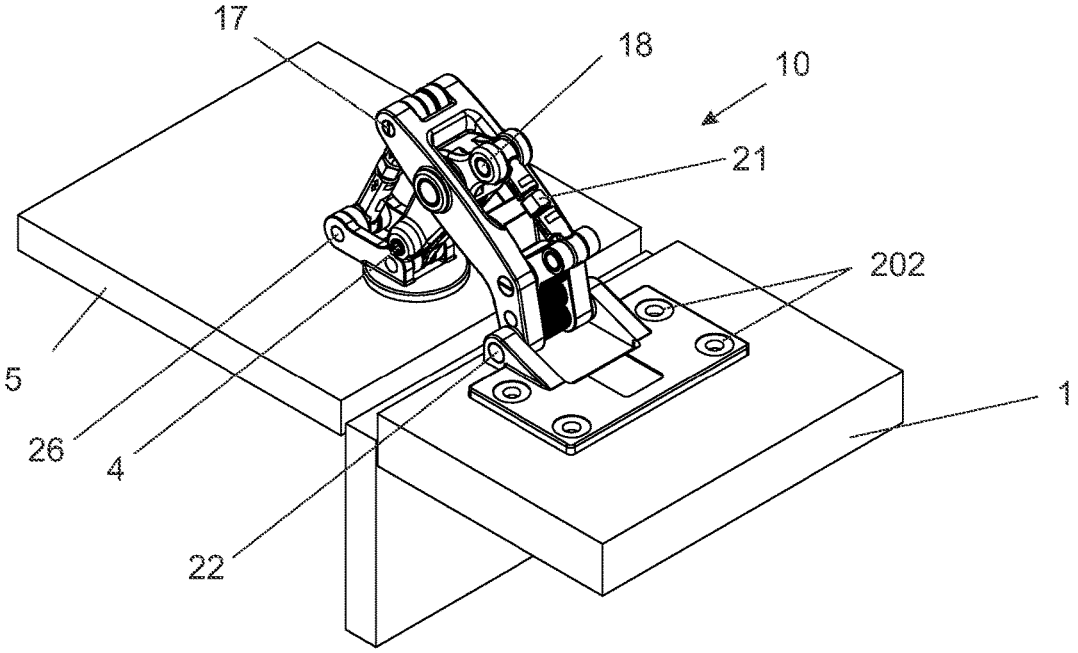
FIG. 2 is a perspective view of the hinge of FIG. 1 shown in an intermediate open position.
Figure 3:
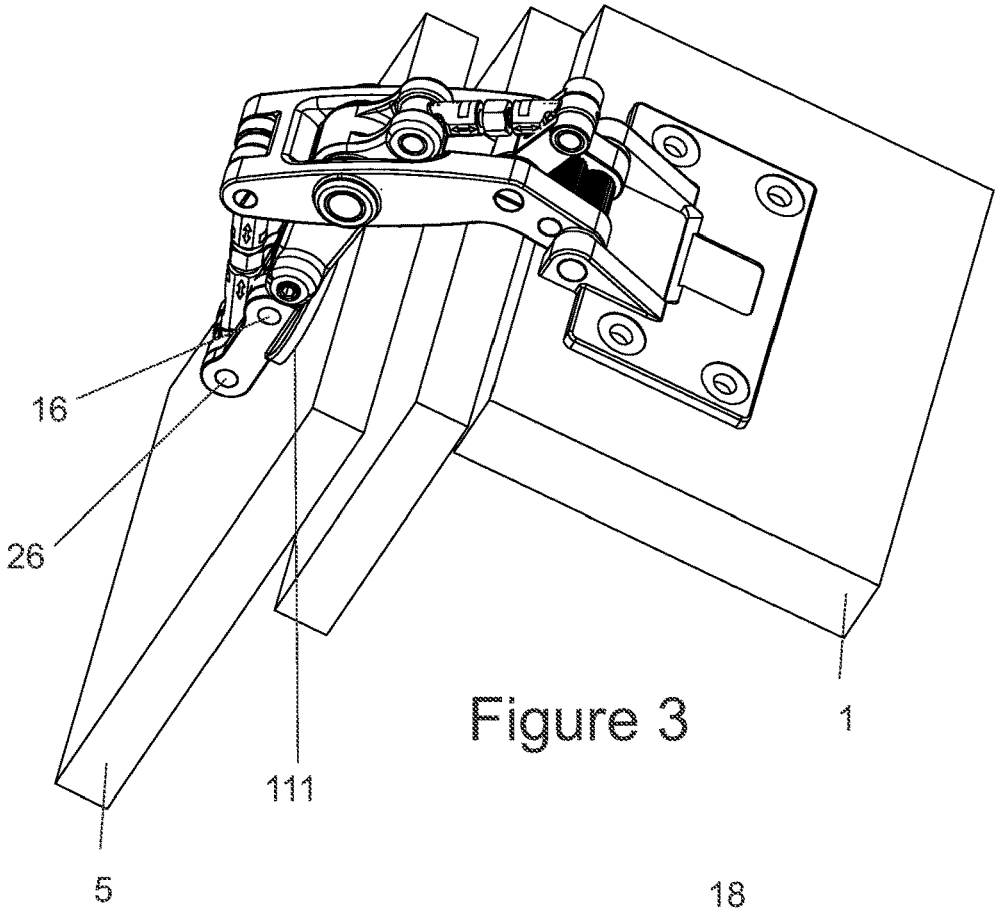
FIG. 3 is a perspective view of the hinge of FIG. 1 shown in an open position.
Figure 4:
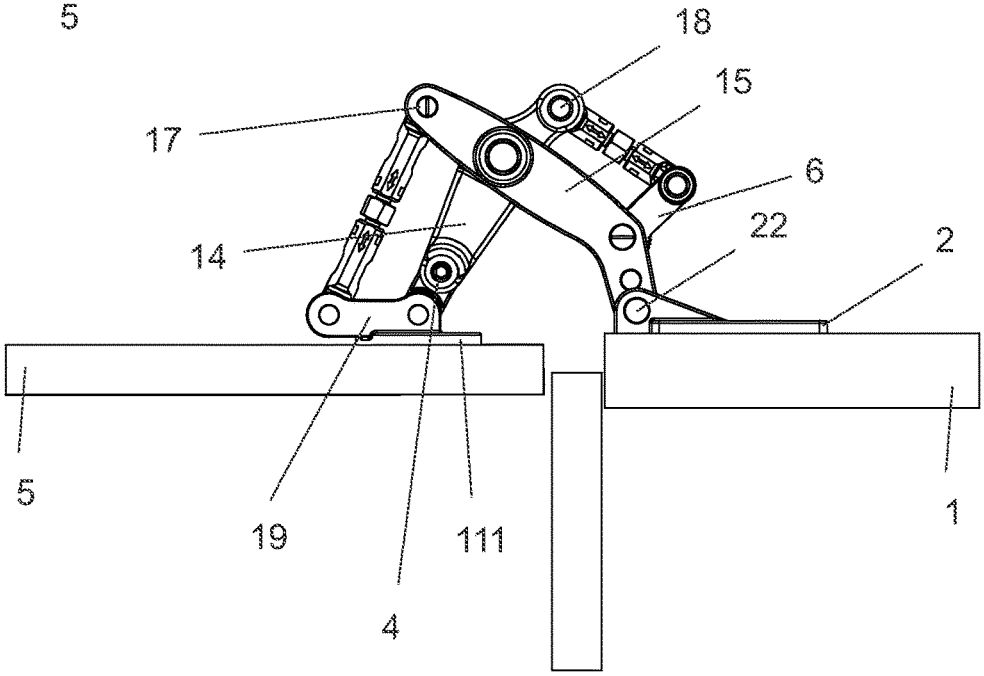
FIG. 4 is a side view of the hinge of FIG. 1 shown in an intermediate position.
Figure 5:
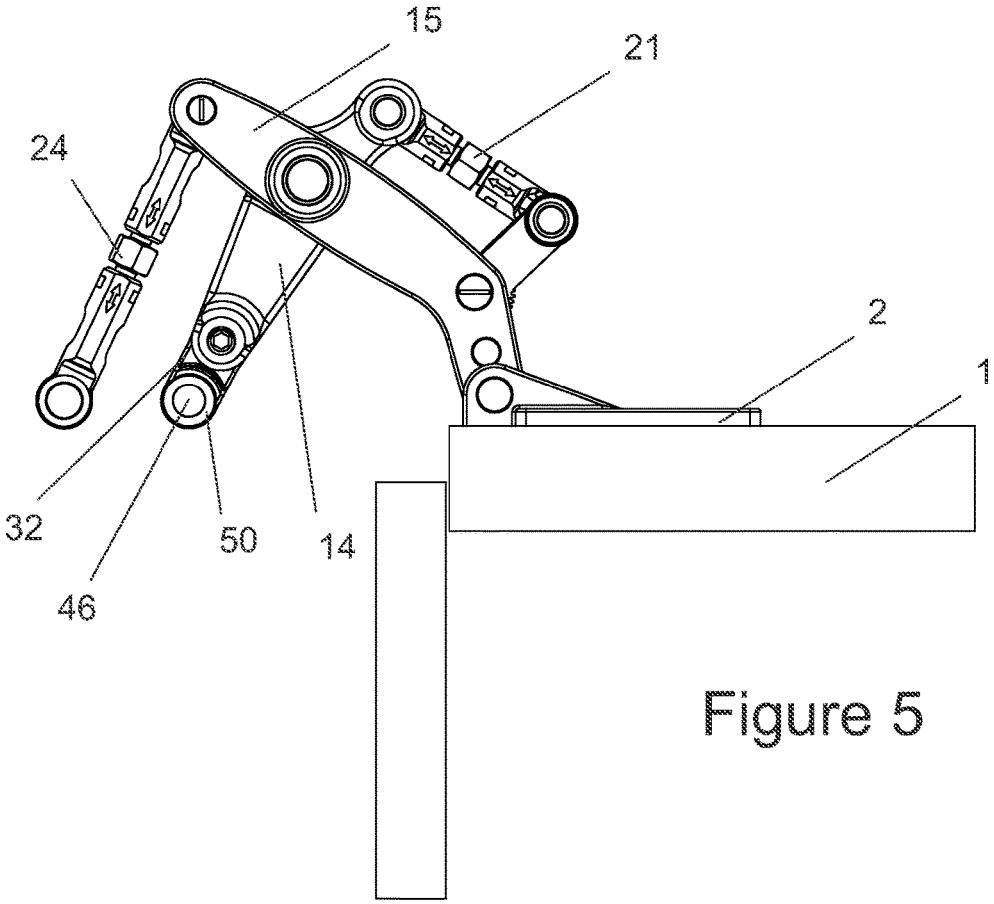
FIG. 5 is a side view of the hinge of FIG. 1 shown without a mounting plate (111) or hinged panel 5 installed.
Figure 7:
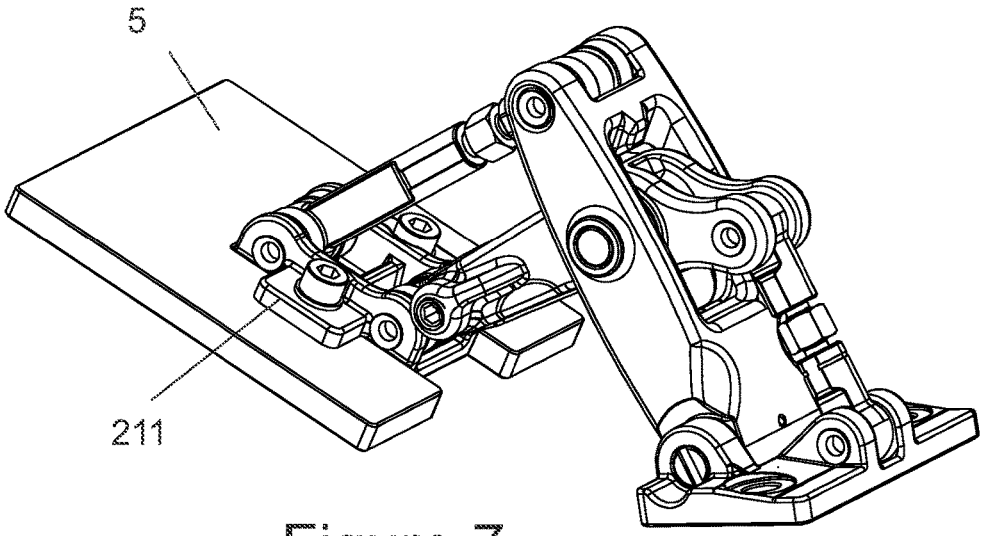
FIG. 7 is a perspective view of the hinge of FIG. 6*b*, shown in an intermediate position and with hinged panel 5 attached.
Figure 6A:
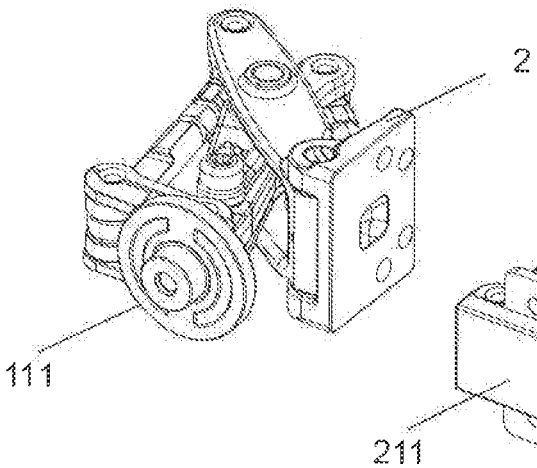
FIG. 6*a* is a perspective view of another hinge showing panel mount variation (111) installed.
Figure 6B:
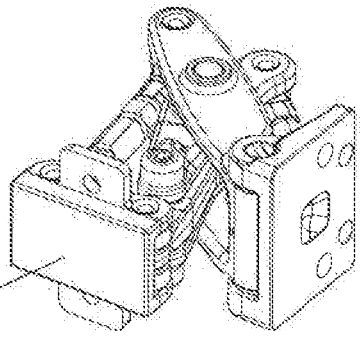
FIG. 6*b* is a perspective view of another hinge showing panel mount variations (211) installed.
Figure 6C:
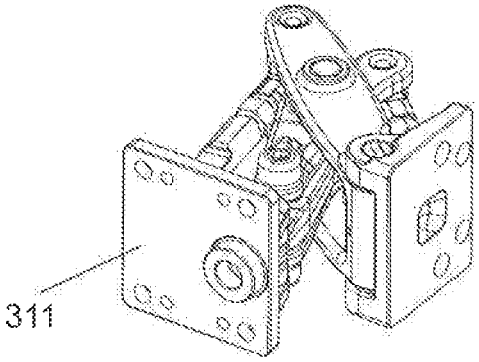
FIG. 6*c* is a perspective view of another hinge showing panel mount variations (311) installed.
Figure 6D:
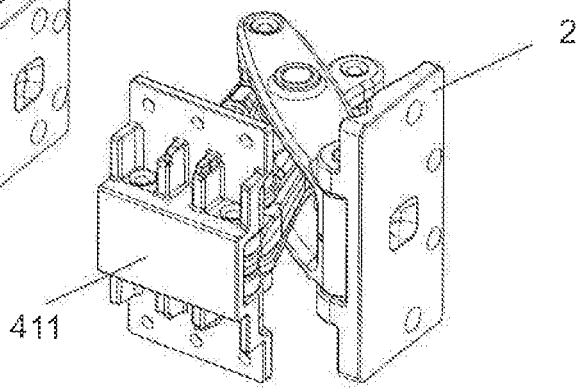
FIG. 6*d* is a perspective view of another hinge showing panel mount variations (411) installed.

In the configuration illustrated in FIG. 2, the gearbox is located inboard of the second arm 15.

In the embodiment illustrated in FIGS. 14 to 16, the gearbox reduces the resultant rotation of geared link 6 with respect to the rotation of arm 15. That is, the angular movement of geared arm 6 is less than the angular movement of arm 15. The desired final drive ratio for the gearbox is highly dependent on the geometry of the rest of the hinge arrangement, and desired opening angle. In particular, the length of geared arm 6, and diameter of the geared portion of geared arm 6, will contribute to the necessary drive ratio for a desired range of motion. It is anticipated that the final drive ratio can be modified to achieve a desirable result for a given hinge geometry and/or desired opening angle.

In an alternative embodiment (not shown), it may not be necessary to include intermediate idler gear 8. That is, gear 9 may mesh directly with geared arm 6. Such embodiments may not require the entire range of motion for example. The idler gear(s) 8, if included, allow a wider range drive ratio to be achieved, while still remaining relatively compact. In fact, the preferred hinge illustrated provides approximately 90° of additional range of motion (i.e. approximately 180° of motion, or more) over existing designs, that are typically limited to around 90°, and yet the hinge still fits within approximately the same footprint as those known hinges.

In other alternative embodiments, the "gearbox" may include additional (i.e. more than one idler gear 8), to achieve even greater ranges of final drive ratio. It is to be understood that the gearbox arrangement provides the ability to fine tune the range of motion of the entire hinge assembly for a wide range of hinge link geometries, to allow tailoring to specific applications.

It will also be appreciated that the total number of gear elements required in the gearbox may depend on the orientation of geared arm 6, to ensure that arm 6 is driven in the correct opening/closing direction, when arm 15 is correspondingly being opened/closed.

Figure 21:
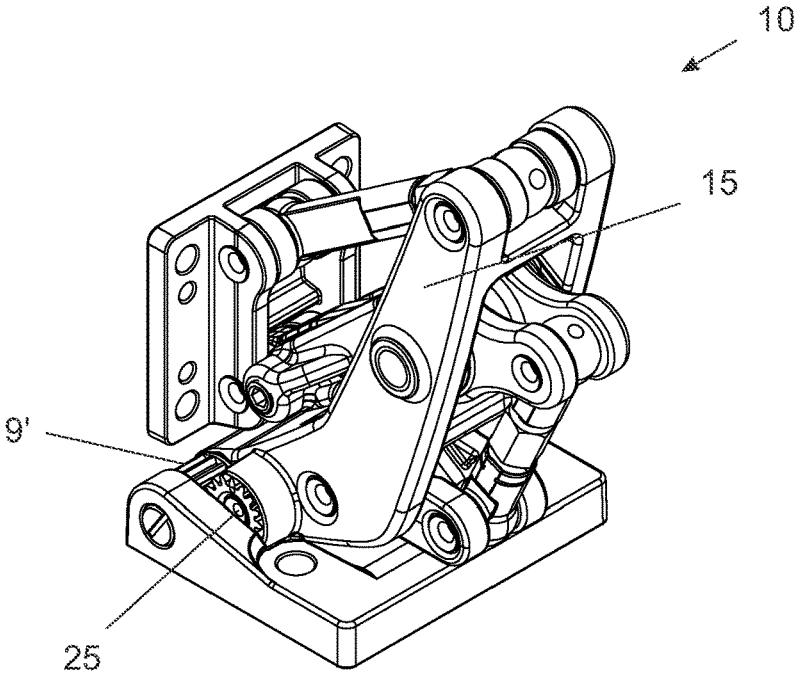
FIG. 21 is a perspective view of an alternative hinge shown in a fully closed position.
Figure 22:
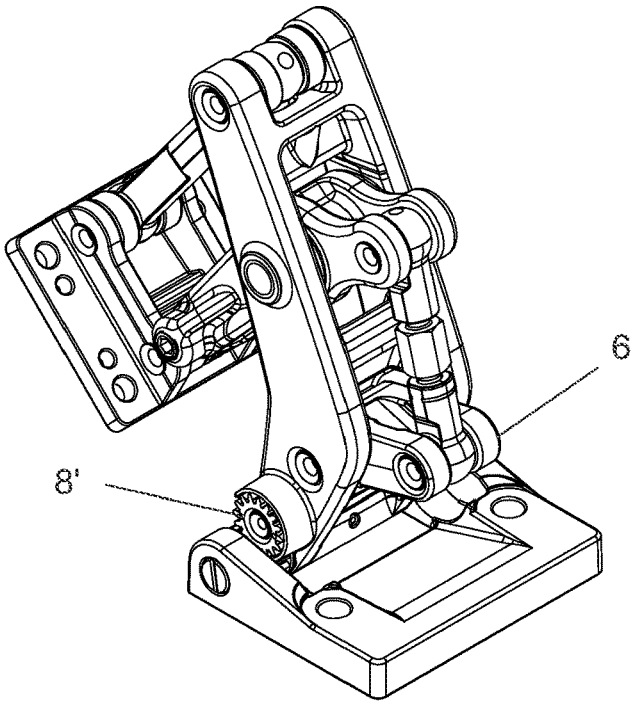
FIG. 22 is a perspective view of the hinge of FIG. 21 shown in an intermediate open position.
Figure 23:
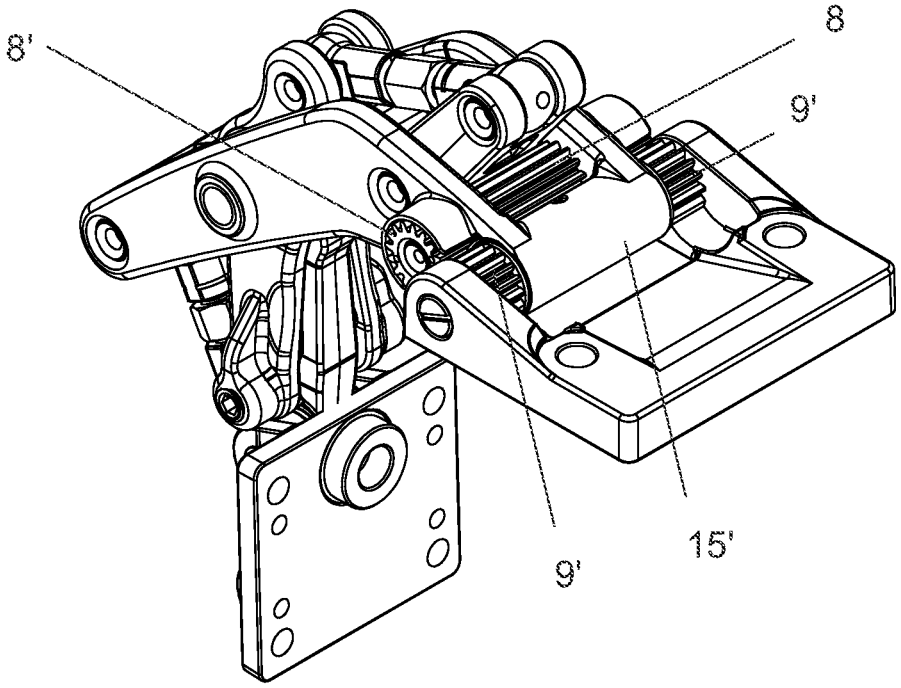
FIG. 23 is a perspective view of the hinge of FIG. 21 shown in an open position.

With reference to FIGS. 21 to 23, an alternative construction will now be described. It will be appreciated in many respects that this alternative construction is equivalent to the previously described construction. However, the configuration of the gearbox elements are not the same.

As shown in FIGS. 21 and 23, gear 9' is located outboard of second arm 15 (preferably on both sides). This arrangement allows second arm 15 to be constructed with additional strength and rigidity, because the end of the arm can be joined (e.g. portion 15').

In this configuration, the gearbox includes additional outboard idler gears 8', which mesh with, and interact on, fixed gears 9'. The torque on idler gears 8' is transferred via shaft 25, to idler gear 8. Motion of idler gear 8, is transferred to gear arm 6, as described in relation to the previous embodiments, thereby causing movement of geared link arm 6, which in turn, drives the opening and closing of the remaining linkages of hinge 10.

The above embodiment results in improved stiffness and rigidity, without significantly adding to the size and/or footprint of the overall hinge. It will be appreciated that further variations of the precise location of various arm, link and/or gear elements are possible without departing from the inventive concept of the 8 axis poly axial hinge.

According to another alternative, it may be desirable to additionally include a mechanism for limiting the range of motion of the hinge 10, by providing a positive stop mechanism (not shown). It may also be desirable to include a positive stop at each end of the range of motion of the hinge 10 (i.e. fully open and fully closed).

For example, second arm 15 may include one or more protrusions located to provide a stop surface that engages with a corresponding surface on geared arm 6. In use, as geared arm 6 reaches a desired motion limit (at either end or both), the services abut and prevent further motion.

In still further embodiments, it is preferred that the positive stop mechanism is adjustable so that the same hinge can provide different ranges of motion, and/or the precise location of the positive stop can be fine tuned during or after installation.

For example, a threaded screw or rod may be mounted to arm 15 to provide a stop surface for engagement with a corresponding stop surface associated with geared arm 6. Alternatively, the corresponding stop surfaces may be associated with second arm 15 and mounting plate 2 respectively. In such embodiments, the threaded (or otherwise adjustable mechanism), can be adjusted to vary the positive stop location as desired.

In still further embodiments, it may be desirable to additionally include a biasing mechanism in order to bias the hinge 10 towards a specific position.

In particular, it may be desirable to bias hinge 10 towards a fully closed position for example. It is anticipated that such a biasing mechanism could be included in a number of different ways, such as a coil spring or a cantilever spring. It is preferred that the spring (not shown) is arranged to act between second arm 15 and geared arm 6, or alternatively to act between mounting plate 2 and second arm 15.

According to still further embodiments, a damper and/or spring assembly may be employed to provide a so-called "soft-closing" option. It is anticipated that a soft closing mechanism may be incorporated into the hinge assembly, or alternatively may be provided as an independent assembly that acts between the hinged panel 5 and fixed frame 1.

For embodiments that incorporate a "soft close" assembly, it is preferred that the spring and/or damper assembly acts between mounting plate 2 and second arm 15, or alternatively acts between second arm 15 and geared arm 6.

In particular, it may be advantageous in designs that incorporate both a "soft close" option, and a biased closing option as described above, to have one mechanism acting between the frame mount 2 and second arm 15, while the other mechanism acts between second arm 15 and geared arm 6. This arrangement may provide more space to incorporate both options.

Alternatively, it is anticipated that one or more of these options ("soft close and biased closing), may act between other elements of the hinge assembly.

For reference the general function and adjustability of the remaining parts of hinge 10 is described in depth, in international patent specification WO2006/062415.

In order to reduce cost, the hinges (for cabinetry applications for example, or other lower loading applications) may alternatively be manufactured from a fibre reinforced polymer material, for example such as glass or carbon fibre reinforced polymer. In such non-metallic embodiments, the height adjusting screws 4 may be held in place by the polymer material of the arm into which they are threaded. No additional locking means may be required, although one could be added if desired.

Due to the pivoting movement of the link arm 32 (about pin 30), the mounting hinge plate 111 must be able to articulate so that it can compensate for the changed orientation caused by angular adjustment of the link arm 32. Articulation of the mounting hinge plate 111 ensures that the plane of the mounting hinge plate 111 can stay parallel to the vertical plane when the link arm 32 is angularly adjusted. If the mounting hinge plate 111 could not articulate with respect to the link arm 32, then the panel which is being held by the mounting hinge plate 111 could not remain in the vertical plane through the entire movement range of the link arm 32. The 3D articulating mounting door plate will compensate and dissipate stress in a glass panel, due to deformation caused by wind or traffic loads for example. This 3D articulated bearing preferably can accommodate a maximum possible angular variation of approximately 5 degrees.

The ability of the mounting hinge plate 111 of the hinge 10 to articulate is particularly important for applications where it is desirable that the mounted panel can move slightly in response to loading to reduce stresses.

The mounting hinge plate 111 is coupled to the first arm 14 via link arm 32. It is also coupled to arm 15 via adjustable link 24. The mounting hinge plate 111 pivots with respect to the first arm 14 about a pin 16 and pivots with respect to the adjustable link 24 about pin 26.

With particular reference to FIGS. 5 and 11-13, a further aspect suitable for optional incorporation into the present invention will now be described. Importantly, this aspect relates particularly to hinging arrangements constructed from metal in order to achieve the highest load carrying ability. However, it is also to be understood that this aspect may also find application in hinges manufactured in polymer, as described earlier.

Link arm 32 has two outwardly projecting convex surfaces 50 at its distal end. The convex surfaces 50 may be frusto-spherical in shape to provide an effective 'ball joint'. The distal end of the link arm 32 has a bore 46 therethrough, which is aligned with the two outwardly projecting convex surfaces 50. The bore 46 provides a passage for the pin 16 to engage to lock the mounting hinge plate 111 to the link arm 32.

Figure 11:
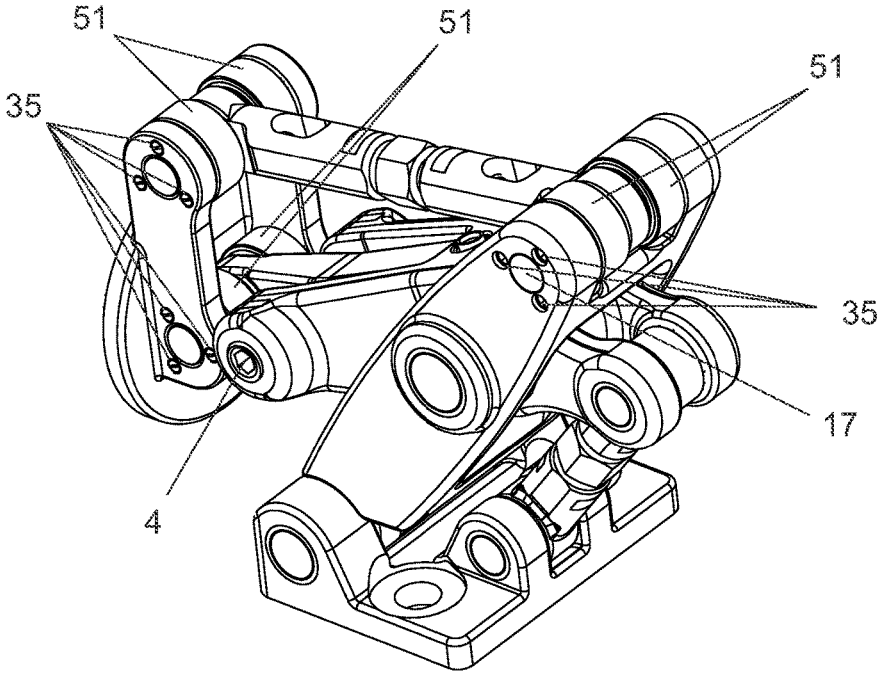
FIG. 11 is a perspective view of another hinge illustrating a further improvement applicable to the present hinge.
Figure 12:
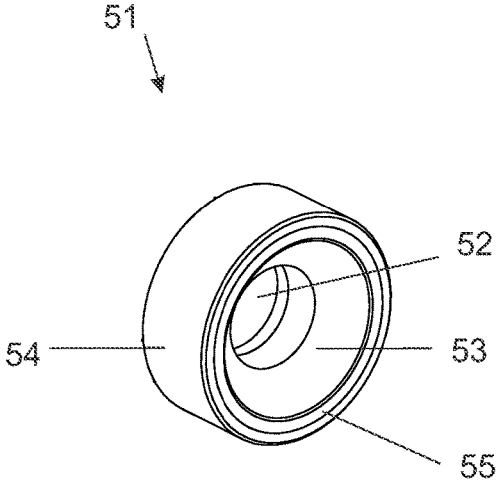
FIG. 12 is a front perspective view of cup 51.
Figure 13:
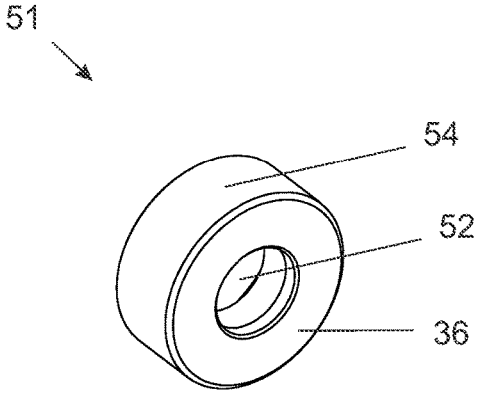
FIG. 13 is a rear perspective view of cup 51 of FIG. 12.

With particular reference to FIGS. 11-13, the assembly includes two cup members 51 located either side of the distal region of the link arm 32 and corresponding with the convex surfaces 50. The cup members 51 and the convex surfaces 50 engage one another in a complementary manner, analogous to a ball and cup joint.

The cups 51 have an internal bore 52 therethrough which corresponds with the diameter of the pin 16. However there is a clearance fit between the bore 46 of the link arm 32 and the pin 16. This clearance fit enables the pin 16 and cups 51 (and therefore the mounting hinge plate 111) to move slightly, relative to the link arm 32. This enables slight articulation of the mounting hinge plate 111.

Preferably the cups 51, are constructed from two pieces as detailed in FIGS. 12 & 13. Cups 51, preferably comprise an outer (preferably) metal case 54 lined with an inner bearing material 55. The bearing material 55 provides complementary concave surfaces 53, while the outer case provides rigidity. Alternatively, the cups 51 may be constructed from one piece of either a metallic or polymer material.

When fitted as shown in FIG. 11, the cups 51 preferably each have at least one set screw 35 (3 shown for each side of each joint) bearing onto the base 36 of the cup 51. In a most preferred embodiment, each cup 51 has three set screws 35. The set screw(s) are threaded into the respective arm or mounting plate of the hinge as shown. The set screws 35 function to allow minute adjustment to the location and/or attitude of the cups 51 with respect to the convex surfaces 50.

This important feature allows for any manufacturing tolerance deficiencies, or wear, to be adjusted out (particularly for metal hinges). Accordingly, the overall hinge product can be manufactured to a lower tolerance, and/or be maintained in situ. Further, the provision of separate cups 51, means that once worn out, these parts can be replaced inexpensively when maintenance is performed.

It has been found that this adjustability is especially important where the hinges are deployed in a high cycle application.

Figure 17:
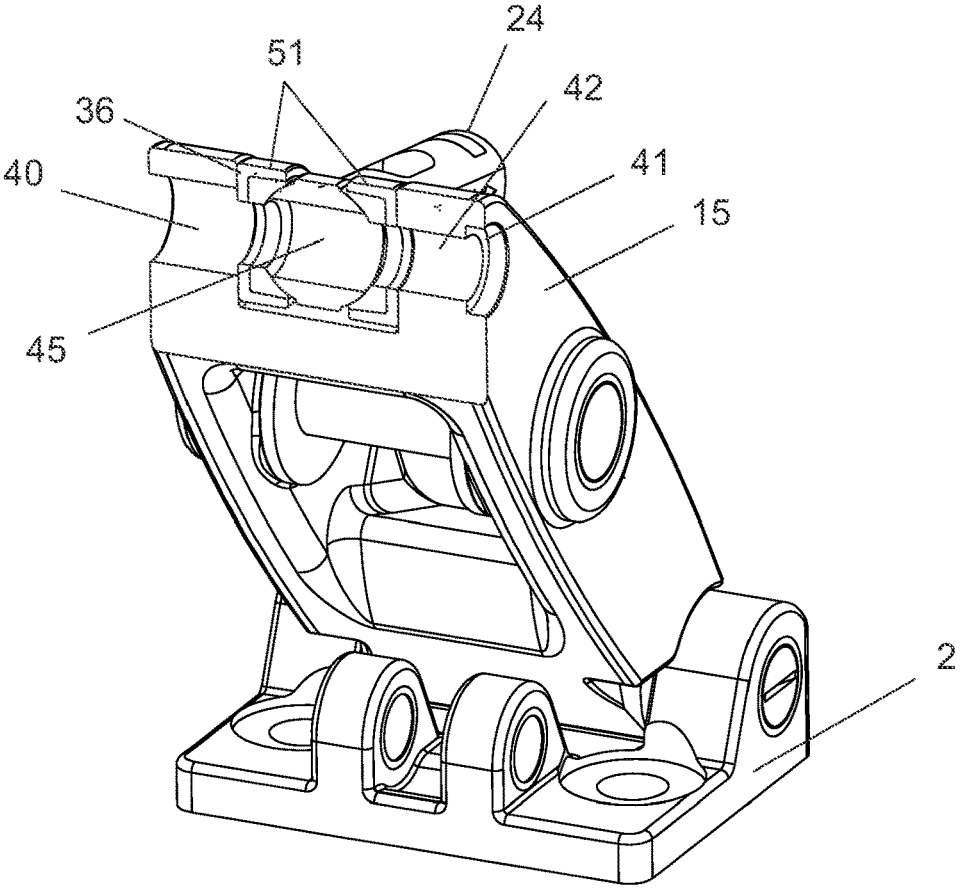
FIG. 17 is a perspective cutaway view of the hinge of FIG. 1 detailing the connection of link 24 to arm 15.
Figure 18:
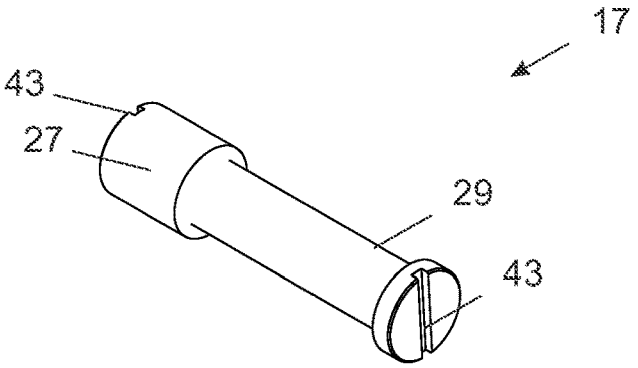
FIG. 18 is a perspective view of a pin 17.

With particular reference to FIG. 17 and FIG. 18, an alternative preferred design for adjusting the cups 51 will now be described in detail. It will be appreciated that this method is described in conjunction with the joint between second arm 15 and adjustable link 24, but that the adjustment mechanism may also be employed on any other link including cups 51.

Pivot pin 17 includes screw member 29 including a threaded end (not visible), coupled to a complimentary threaded sleeve member 27. Link arm 24 is pivotally coupled on pin 17 via aperture 45 in the turnbuckle of the link 24. In order to facilitate adjustability of the hinge, it is preferred that aperture 45 is larger than the outer diameter of the smooth portion of pin element 29, as described above in relation to the set screw mechanism.

Cups 51 engage either side of the spherical surfaces of link 15, to provide complementary bearing surfaces, to facilitate smooth articulation of the joint. In order to compress cups 51 onto the turnbuckle of link 42, the two parts of pin 17 (27,29), can be tightened together. Slots 43 are preferably provided in each of parts 27 and 29 for this purpose.

As pin 17 is tightened, the head of pin 29 abuts surface 41 on arm 15, while the threaded sleeve 27 abuts the base 36 of the adjacent cup 51, resulting in compression of cups 51, and the turnbuckle of link 24, against one side of second arm 15. In this way any 'play' in the joint can be removed, and/or compensation for worn parts can be simply addressed during maintenance.

This adjustability may also be important, to improve longevity. That is prolonged use of the hinge may result is some additional play caused by wear, which can be adjusted out during periodic maintenance. This aspect may apply to both metallic and polymer hinges. It will be appreciated that the method of adjusting the location and/or attitude (i.e. angular orientation) of the cups 51 via set screw is one preferred example method.

Many other methods of providing the necessary movement of the cups 51 relative to the convex surfaces 50 can be employed. Similarly, sets screws may be provided on only one side of the joint (i.e. to only one cup per joint).

The complementary fit between the outwardly projecting convex surfaces 50 and the concave surfaces 53 of cup members 51, enables the slight articulation and is effective in transferring force between the components.

The curved surfaces between the respective surfaces 50 and 53 provides a greater area for force transfer, this force transfer interface deters force from being transferred in a point loading manner, while the adjustability of the location and/or attitude of the cups 51 allow precise mating where machining tolerances are not able to produce an exact fit. This is especially important to increase the longevity of the hinge. Point loading of the components can result in wear and tear when used in high cycle applications.

This aspect may be less critical in hinges that are manufactured from polymer materials because the material is itself more flexible and as a result can 'self-adjust' to some degree.

While the above describes the main connection between the hinge mounting plate and the main arm 32, the connection between the adjustable link 24 and the mounting hinge plate 111 may be of the same type. The distal end of the adjustable link 24 may also have two outwardly projecting convex surfaces 50 which engage with cup members 51.

Therefore the connection between the adjustable link 24 and the mounting hinge plate 111 can also facilitate articulation of the mounting hinge plate 111. This assembly ensures freedom to articulate sufficiently to accommodate likely height adjustments of the link arm 32 when the hinge 10 is mounted to a fixed structure via the mounting base 2.

Similarly, the connection at the other end of the adjustable link 24 may also utilise a "ball and cup" arrangement as described above with reference to the connection arrangement between the link arm 32 and the mounting hinge plate 111. In such a configuration, outwardly projecting convex surfaces 50 (nor shown) may be present on the proximal end of the adjustable link 24. Cup members 51 are provided to engage with the convex surfaces 50. A pin 17 is provided to tie the proximal end of the adjustable link 24 and the cup members 51 to the second arm 15 as shown in FIG. 11. Such an arrangement facilitates articulation of the adjustable link 24 relative to the second arm 15.

It should be appreciated that the "ball and cup" connections consisting of outwardly projecting convex surfaces 50 and complementary cup members 51 may be present between any of the various linkages of the hinge. Such connections allow for some degree of articulation between parts of the hinge, and especially promote articulation of the mounting element 111.

It should be appreciated that the hinge of the present invention may be suitable for any other applications including but not limited to the architectural industry (residential and commercial), the marine industry, the transport industry, the aircraft industry, and any other application where hinged mounting of heavy panels (as detailed above) is desirable with only a pair (or reduced number) of hinges.

With reference to FIG. 6*a-d*, some alternative example panel mounting plates are illustrated (111, 211, 311, 411). It will be appreciated that a wide variety of size, shape and style mounting plates, 111 and 2, may be employed with the present hinge in order to tailor the hinge assembly to different types or different material hinged panels 5, and or load bearing capability.

Figure 19:
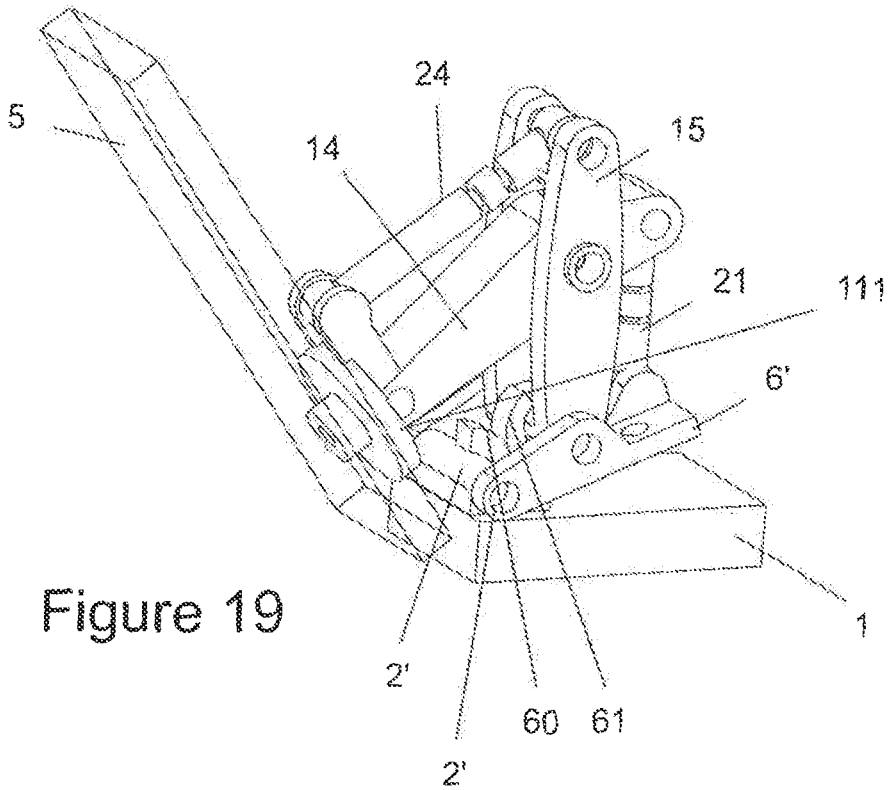
FIG. 19 is a perspective view of an alternative hinge arrangement, shown partially open.
Figure 20:
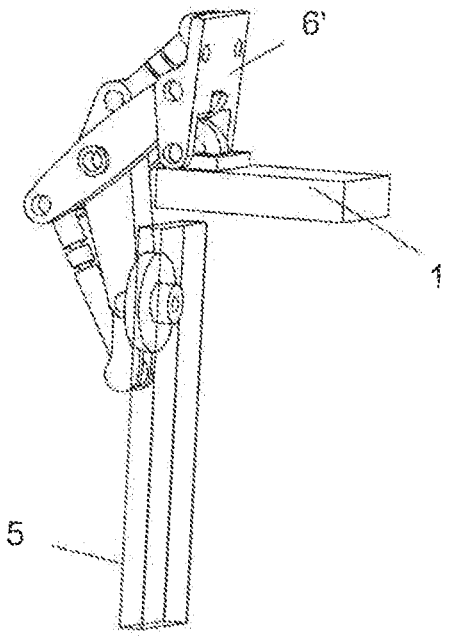
FIG. 20 is a perspective view of the hinge arrangement of FIG. 19 showed fully open.

With reference to FIGS. 19 and 20, an alternative hinging arrangement including meshing gears and providing extended range of motion up to 180° and beyond will now be described in detail.

It will be appreciated that many parts of this design are analogous to the hinges described above, accordingly the same or similar reference numerals will be used in order to aid interpretation, and the following description will primarily focus on the differences.

In this embodiment, arm 6' is pivotably mounted to second arm 15, however it does not include a gear portion. Instead, arm 6' extends to, and is pivotally coupled to, mounting plate 2'.

Mounting plate 2' includes geared portion 60 rigidly fixed with respect to mounting plate 2'. Second arm 15 also includes corresponding rigidly fixed geared portion 61, located to mesh with geared portion 60.

During movement of the second arm 15 of the hinge, geared portion 61 interacting with geared portion 60, causes mounting plate 6' to rotate about pivot 22. As a result, mounting plate 6' rises up off fixed frame 1, and the entire hinge assembly rotates thereby extending the opening range of motion.

As shown in FIG. 20, a range of motion up to 180°, and beyond, is possible with this design.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A poly axial hinge comprising:

a mounting plate, a first arm pivotally coupled to a panel mounting element at its first end, a second arm pivotally coupled in a scissoring manner with the first arm by a main pivot, and pivotally coupled to said mounting plate at its first end, a third arm pivotally coupled at a first end to said second arm at a location part way between said first end of said second arm and a said main pivot, a first link member pivotally coupled at one end to a second end of said second arm, and pivotally coupled at another end to said panel mounting element, a second link member pivotally coupled at one end to a second end of said first arm, and pivotally coupled at another end to another end of said third arm, wherein said mounting plate includes at least one rigidly fixed first gear, and said third arm includes gear teeth directly or indirectly coupled together with said fixed gear, such that rotation of said second arm with respect to said mounting plate causes rotation of said first arm with respect to said second arm thereby driving the poly axle hinge open and/or closed.

2. The poly-axial hinge of claim 1, wherein said hinge includes one or more further gears located between said first gear and said third arm, all engaged to transfer motion between said first gear and said gear teeth of said third arm.

3. The poly-axial hinge of claim 1, wherein said at least one fixed gear is arranged inboard of said second arm.

4. The poly-axial hinge of claim 1, wherein said at least one fixed gear is arranged outboard of said second arm.

5. The poly-axial hinge of claim 1, wherein said second arm is bent when viewed from a direction parallel to said pivotal couplings.

6. The poly-axial hinge of claim 1, wherein there are a total of eight pivoting couplings.

7. The poly-axial hinge as claimed in claim 1, wherein the first arm is a composite arm comprising a height control arm portion and a main arm portion;

wherein the height control arm portion is pivotally coupled to the main arm portion;

said first end of said first arm comprises an end of said height control arm portion; and said end of said height control arm portion is moveable relative to said main arm portion.

8. The poly-axial hinge of claim 1, wherein said first link member and said second link member are adjustable in length.

9. The poly-axial hinge of claim 1, wherein said hinge includes one or more further gears located between said first gear and said third arm, all engaged to transfer motion between said first gear and said gear teeth of said third arm.

10. The poly-axial hinge of claim 1, wherein said second arm is bent when viewed from a direction parallel to said pivotal couplings.

11. A poly axial hinge comprising:

a mounting plate, a first arm pivotally coupled to a panel mounting element at its a first end, a second arm pivotally coupled in a scissoring manner with the first arm by a main pivot, a third arm pivotally coupled to said second arm at a location part way between a first end and a second end of said third arm, and pivotally coupled to said mounting plate at its first end, a first link member pivotally coupled at one end to a second end of said second arm, and pivotally coupled at another end to said panel mounting element, a second link member pivotally coupled at one end to a second end of said first arm, and pivotally coupled at another end to another end of said third arm, wherein said mounting plate includes a rigidly fixed first gear teeth, and a first end of said second arm includes second rigidly fixed gear teeth, said first gear teeth and said second gear teeth cooperating such that rotation of said panel mounting element with respect to said mounting plate causes rotation of said third arm.

* * * * *